United States Patent [19]

Roth et al.

[11] Patent Number: 4,519,859

[45] Date of Patent: May 28, 1985

[54] HEATING SYSTEM FOR AND METHOD OF FINALLY BONDING CONTAINER END UNIT TO BODY

[75] Inventors: Donald J. Roth, Westport; Charles S. Kubis, Weston, both of Conn.; John Walter, Evergreen Park, Ill.; Glenn R. Mohr, Linthicum, Md.

[73] Assignee: Continental Can Company, Inc., Stamford, Conn.

[21] Appl. No.: 569,888

[22] Filed: Jan. 11, 1984

[51] Int. Cl.[3] ..... B32B 31/20

[52] U.S. Cl. ..... 156/69; 29/458; 53/325; 156/274.6; 156/274.8; 156/294; 156/295; 156/379.8; 156/380.9; 156/423; 220/359

[58] Field of Search ..... 53/325; 156/69, 293, 156/294, 295, 423, 274.6, 274.8, 379.8, 380.9; 29/458; 220/359; 229/5.7

[56] References Cited

U.S. PATENT DOCUMENTS

| | | | |
|---|---|---|---|
| 3,879,921 | 4/1975 | Leonard | 53/325 |
| 4,304,038 | 12/1981 | Yabu et al. | 156/295 X |
| 4,373,983 | 2/1983 | Walter | 156/294 X |
| 4,415,387 | 11/1983 | Newman | 156/69 |

*Primary Examiner*—Robert A. Dawson
*Attorney, Agent, or Firm*—Charles E. Brown

[57] ABSTRACT

This relates to a system for reheating adhesive bonding an end unit to a can body under controlled conditions and then further telescoping the end unit relative to the can body to assure proper adhesive flow relative to the can body. An end unit has been previously applied to a can body and is bonded thereto by a hot melt adhesive which has partially set. The end unit is not in its fully telescoped position. The adhesive is reheated to a temperature wherein the adhesive has the desired fluidity, after which the adhesive is maintained at this temperature and the end unit is moved to its fully telescoped position with a bead of the adhesive flowing over and encapsulating the raw edge of the can body.

20 Claims, 7 Drawing Figures

HEATING SYSTEM FOR AND METHOD OF FINALLY BONDING CONTAINER END UNIT TO BODY

This invention relates in general to new and useful improvements in can making, and more particularly to securement of a metal end unit to a metal can body utilizing an adhesive bond.

It has been proposed to form cans wherein, in lieu of the conventional end unit which is secured to the body by a double seam, the end unit be in the form of a dome which has a very short skirt portion which is telescoped over an upper end of a can body and is secured thereto solely by way of an adhesive bond. In a practical application of making such a can, adhesives are applied to the interior of the end unit skirt with the adhesive being preferably in the form of a hot melt adhesive. The adhesive is spread axially along the interior of the skirt and terminates in a bead. It is the intent of the provision of the bead that it engages the raw edge of the free end of the can body and that it flows along such raw edge to form a complete protection and sealant for the raw edge.

When the end unit and can body are initially assembled, the end unit is not fully seated on the can body. Thereafter, the assembled end unit and can body are subject to further heating steps which include a first heating to elevate the temperature of the adhesive to that which will provide for the desired flowable characteristics of the adhesive. Only after the adhesive reaches the desired fluid condition is the end unit further pressed onto the body. When the adhesive is in this fluid condition, the raw edge of the body engages the adhesive bead and moves axially into the adhesive bead with the adhesive bead in part flowing with the extreme end of the body and in part flowing around the raw edge.

With the above and other objects in view that will hereinafter appear, the nature of the invention will be more clearly understood by reference to the following detailed description, the appended claims, and the several views illustrated in the accompanying drawings.

IN THE DRAWINGS

Figures 1, 2, 3, 4, 5:
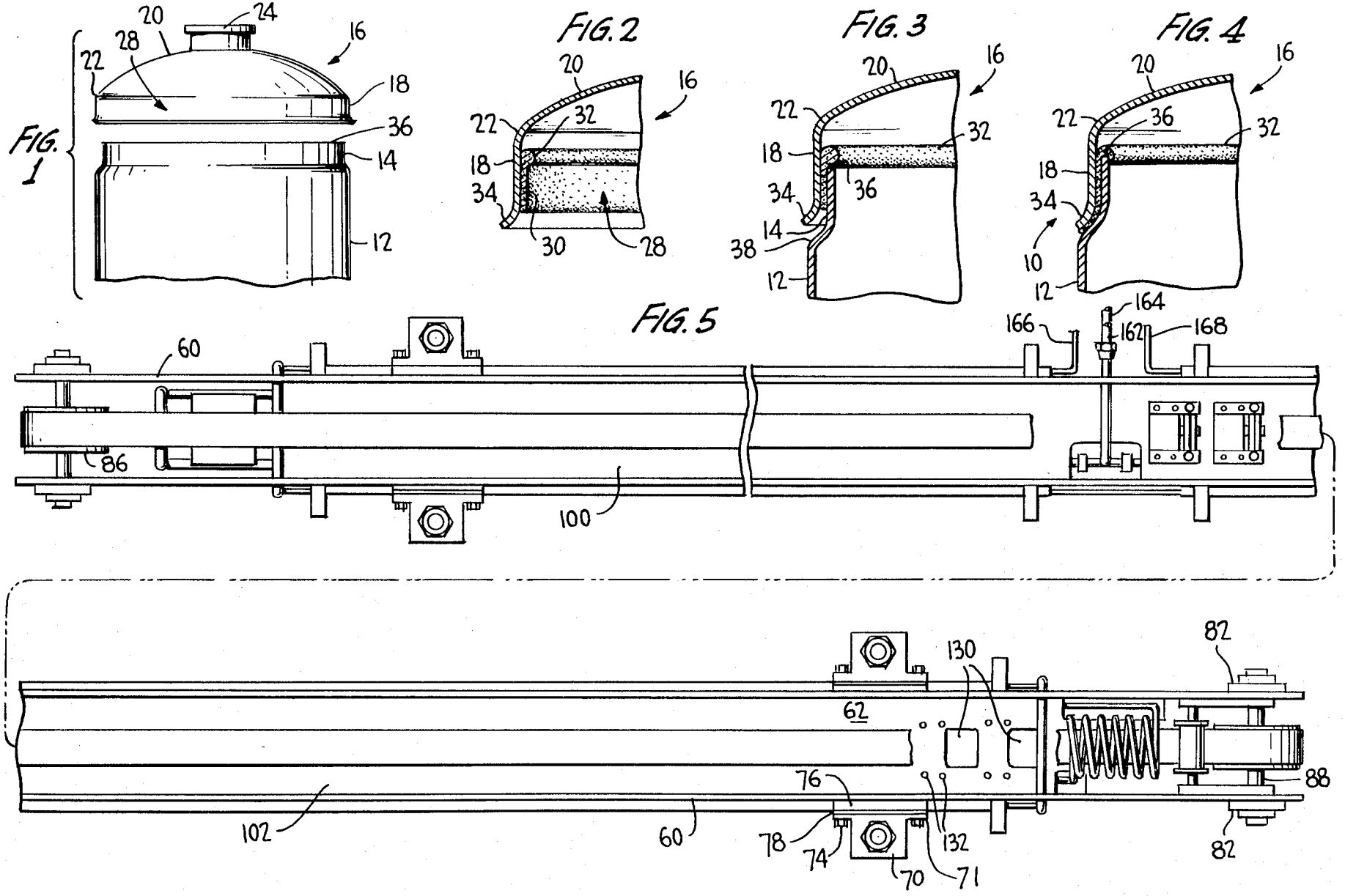
FIG. 1 is a fragmentary elevational view with parts in section, showing the details of an end unit and a can body prior to assembly.
FIG. 2 is an enlarged fragmentary sectional view through the end unit, and shows the initial deposit of adhesive thereon.
FIG. 3 is an enlarged fragmentary sectional view showing the end unit as initially assembled with the can body.
FIG. 4 is another sectional view similar to FIG. 3, and shows the final assembly of the end unit with the can body.
FIG. 5 is a plan view of the adhesive activator assembly formed in accordance with this invention.

Referring now to the drawings in detail, reference is first made to FIG. 1 wherein there is shown components of a can prior to assembly of the components, the can being generally identified by the numeral 10. The can 10 includes a can body 12 which is preferably formed by a drawing operation and which will have an integral bottom (not shown). In the preferred form of can body, the extreme upper end is necked in as at 14 a distance slightly greater than the wall thickness of the body 12.

The can 10 also includes an end unit 16 which is preferably in the form of a dome. The end unit 16 includes a lower skirt 18 of an internal diameter snugly to telescope over the necked-in portion 14. The skirt 18 is joined to a domed portion 20 by means of a part toroidal section 22. The dome 20 has an upper neck portion 24 which is particularly adapted to receive a closure fitment which forms no part of this invention.

The skirt 18, as is best shown in FIG. 2, has applied to the inner surface thereof adhesive 28. The adhesive 28 is primarily in the form of a thin layer 30, but includes a bead 32. It is also noted that the skirt is provided at its free edge with an out-turned flange 34.

The adhesive 28 is automatically applied to the interior of the skirt 18 and the end unit 16 is automatically assembled to a limited extent with the can body 12. This relationship is shown in FIG. 3.

It is to be understood that the adhesive 28 is a hot melt adhesive which is applied to the end unit 16 and, before there is material cooling and setting of the adhesive, the end unit is applied to the can body. However, it has been found not to be commercially feasible to fully seat the end unit on the can body when the end unit is applied thereto.

In accordance with this invention, the assembled end unit 16 and can body 12 are subject to an adhesive activator assembly which will be described hereinafter. The assembly receives a line of moving can bodies and, through induction heating, heats the adhesive 28 until it is of the desired fluidity. Then the end unit 16 is pressed axially down further onto the can body 12 with the raw edge 36 of the can body at the open end thereof moving into engagement with the bead of adhesive 32 and serving to wipe the adhesive upwardly with some of the bead 32 flowing between the necked-in portion 14 and the skirt 18 and other of the bead 32 flowing around the raw edge 36 to fully encapsulate the same.

It will be understood that the dome 16 is pressed down onto the can body so that each and every can 10 will be of the same height. This facilitates later stacking. When the can body is fully pressed into place, the flange 34 is substantially touching a shoulder 38 formed on the can body 12 below the necked-in portion 14. The assembled can is shown in FIG. 4.

Figure 6:
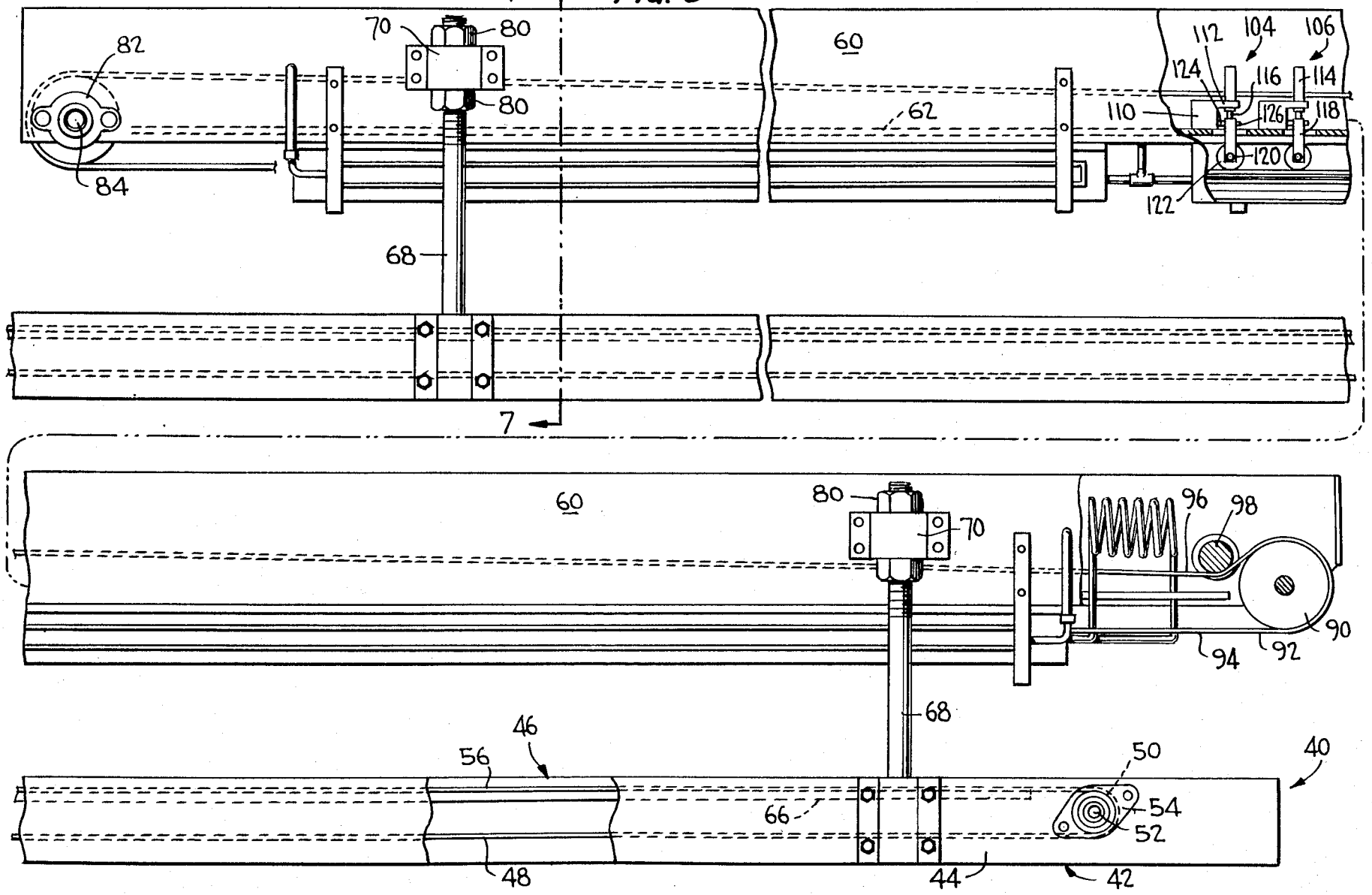
FIG. 6 is a side elevational view of the assembly of FIG. 5 with parts broken away to show the details thereof.
Figure 7:
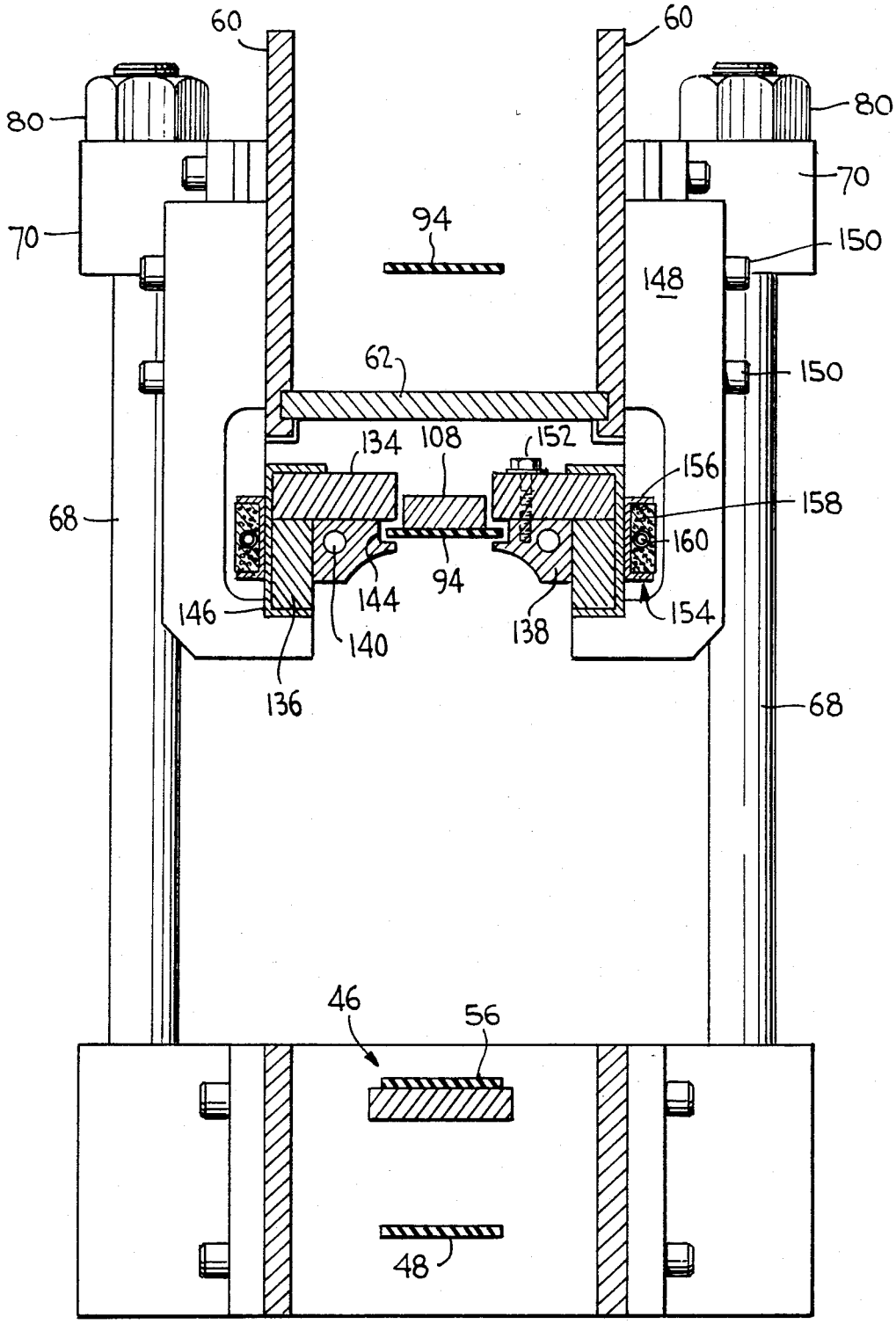
FIG. 7 is an enlarged transverse vertical sectional view taken generally along the line 7—7 of FIG. 5, and shows the specific cross section of the assembly.

Reference is now made to FIGS. 5, 6 and 7 wherein there is illustrated the details of the adhesive activator assembly which is generally identified by the numeral 40. The assembly 40 includes an elongated lower support 42 which is mounted at the required height by a suitable supporting framework (not shown). The support 42 includes a pair of side plates 44 which are suitably joined together and which carry a conveyor of the endless belt type, the conveyor being generally identified by the numeral 46. The conveyor 46 includes a belt 48 of which one end is entrained around a roller 50 carried by a shaft 52 which has its opposite ends mounted in suitable bearing units 54 secured to the outer faces of the side plates 44. The conveyor belt 48 has an upper run 56 which is positioned between the side plates 44 below the upper edges thereof.

The support 42 carries in overlying relation thereto a heater assembly generally identified by the numeral 58.

The heater assembly has a frame which is primarily defined by a pair of upstanding side plates 60 which are joined adjacent their lower edges by spacer plate 62 with the side plate 60 being joined to the spacer plate 62 by suitable fasteners 64, as is shown in FIG. 7.

The side plates 44 carry at spaced intervals brackets 66 which, in turn, carry upstanding support rods 68 of which the upper portions are externally threaded. The side plates 60 are provided in alignment with the brackets 66 with brackets 70 which are positioned as is best shown in FIG. 5. Each bracket 70 has a mounting flange 72 which is secured to a respective side plate 60 by fasteners 74. If desired, suitable spacers or mounting plates 76 and 78 may be employed.

The mounting bracket 70 has a vertical bore therethrough which receives the associated support rod 68 and the heater assembly 58 is supported at an adjusted height relative to the support 42 by means of nuts 80 which are threaded onto the support rod 68 above and below the bracket 70.

Adjacent the opposite ends thereof, the side plates 60 are provided with pairs of transversely aligned bearing assemblies 82. The bearing assemblies 82 at the left end of the side plates 60 carry an idler shaft 84 on which an idler or return roller 86 is mounted. The bearing assemblies 82 at the right end of the side plates carry a shaft 88 which extends transversely of the heater assembly 58. The shaft 88 has a portion extending beyond one of its associated bearing assemblies 82 to which a suitable drive unit may be coupled. Thus the shaft 88 is a driven shaft. The shaft 88 carries a drive pulley 90.

An endless belt 92 is entrained over the pulleys 86 and 90 and has a lower run 94 generally opposing the upper run 56 of the conveyor 46. The endless belt 92 also has an upper or return run 96 which is positioned between the side plates 60. If desired, an idler pulley 98 may be provided to assure proper entrainment of the belt around the pulley 90 and also to properly vertically position the return run 96 of the belt. A similar idler pulley 98 will be provided at the left end of the heater assembly.

The purpose of the belt 92 is twofold. First of all, it is pointed out here that it runs at the same speed as the conveyor belt 48. At the left end of the run 94, the run 94 together with the conveyor belt run 56 moving from left to right, the run 94 will engage the top of the end unit 16 only with sufficient force to retain a conveyed can 10 in an upstanding position. Insufficient pressure is applied to the dome by the left-hand part of the belt run 94 to cause the end unit to move downwardly on the can body.

In accordance with this invention, there is provided in the heater assembly a primary heating section 100 and a secondary heating section 102 which will be described in detail hereinafter. These heating sections are spaced from one another in the central portion of the heater assembly, and there is mounted within the heater assembly 58 a pair of pressure applying units 104 and 106 which are identical. At this time it is pointed out that the belt 92 is a pressing belt, and in the lefthand half of the heater assembly, it is retained against upward movement by a guide shoe 108 which is suitably carried by the side plate 60 and which guide shoe 108 runs parallel to the conveyor belt upper run 56. Thus the pressing belt lower run 94 can apply the aforementioned light pressure to the end unit.

The purpose of the pressure applying units 104, 106 is to apply a pressing force to the pressing belt lower run 94 which is transferred to the partially assembled can after the adhesive 28 has become sufficiently fluid so as to force the end unit 16 further down onto the can body and to initiate the spreading of the bead of adhesive 32 by the raw edge of the can body 12. Each of the pressure applying units 104, 106 includes a support 110 which is seated on and is suitably secured to the plate 62, as is best shown in FIG. 5. The support has at the opposite sides thereof forwardly projecting ears 112 which carry spring assemblies 114. Each spring assembly 114 has extending downwardly therefrom a rod 116 which, in turn, is connected to a support rod 118 having received in the lower end thereof the end of a transverse shaft 120 which has mounted thereon a pressing roller 122. The support rods 118 have upper end portions thereof guided in a guide block 124 which is secured to a face of the support 110 by fasteners 126. It is to be understood that the spring assemblies 114 normally hold the roller 122 down in a position to apply through the pressing belt run 94 a force on an end unit 16 sufficient to press that end unit down relative to the can body from its initial position. If desired, the force may be sufficient to fully seat the end unit on the can body. There is suitably mounted by the heater assembly 58 downstream of the pressing units 104, 106 a further guide 128 for the upper surface of the pressing belt run 94. Depending upon the function of the pressing units 104, 106, the guide 128 may either serve merely to hold the end unit fully seated on the can body, or it may slope downwardly from left to right to gradually press the end unit downwardly relative to the can body to its final seated position.

Referring to the right end of FIG. 5, it will be seen that the spacer plate 62 is provided with suitable openings 130 and threaded bores 132 for the mounting of further pressing units 104, 106. The mounting of further pressing units, in addition to the pressing units 104, 106, may assure the final seating of the end unit on the can body. On the other hand, the pressing units at the central portion of the heater assembly 58 may be eliminated and the pressing units be installed only at the right end of the heater assembly with the guide 128 serving gradually to press the end unit down on the can body to its final position.

Heating of the adhesive 28 is effected by induction heating. Each of the two heating sections 100 and 102 is of such a construction.

Reference is now made to FIG. 7 which is taken through the primary heating section and shows the general details of the coil assembly of that heating section. First of all, there are two ferrite blocks 134, 136 which are arranged at right angles to each other and in overlapping relation so as to define a lower inner corner. A coil element 138 is positioned in the lower corner and is basically is the form of a solid bar of highly electrically conductive material such as copper. The electrode 138 will have a bore 140 therethrough for a coolant.

It will be seen that the electrode 138 has a lower surface 142 which is curved or arched generally to match the curve or arch of the dome 20 of the end unit. Further, it will be seen that the inner edge of the electrode 138 is notched as at 144 to provide clearance for the lower pressing belt run 94.

The ferrite blocks 134, 136 are mounted in a C-shaped channel support 146 which is, in turn, carried by mounting blocks 148 which are spaced longitudinally of the heater assembly 58 and have upper portions overlapping and fixedly secured to the outer faces of the side plates 60 by means of fasteners 150. It will be seen that the electrode 142 is releasably secured in place relative to the ferrite blocks 134, 136 by means of fasteners 152 which extend downwardly through the ferrite blocks 134 and are threaded into the electrode.

If desired, there may also be a cooling assembly associated with each electrode, the cooling assembly beinidentified by the numeral 154 and being mounted on the outer vertical face of the channel bracket 146. The cooling assembly 154 also includes a C- or channel-shaped bracket 156 in which there is mounted a suitable insulating material 158 which surrounds a coolant line 160.

It is to be understood that the secondary heating section 102 will be of essentially the same construction as the primary heating section 100, but will be varied to the extent that it supplies to the cans passing therealong only sufficient energy to maintain the temperature of the adhesive 28 which has been heated by the primary heating section 100.

Referring now to FIG. 5, it will be seen that the electrodes (coils) of the two heating sections have leads 162, 164 which will be connected to the transformer of a high frequency generator. In a like manner, the coolant line 160 will be provided with an inlet 166 and a discharge 168.

In use the adhesive activator assembly 40 will be positioned immediately adjacent the mechanism which applies adhesive 28 to the end unit 16 and then applies the end unit to the can body. Suitable conveyor means (not shown) will transfer the assembled cans to the adhesive activator assembly 40.

Although only a preferred embodiment of the adhesive activator assembly has been specifically illustrated and described herein, minor modifications may be made therein without departing from the spirit and scope of the invention as defined by the appended claims.

We claim:

1. An adhesive activator assembly, said assembly being particularly adapted for reheating an adhesive which is bonding an end unit to a container body and finally axially positioning such end unit on its respective container body while the previously applied adhesive is flowable, said adhesive activator assembly comprising a conveyor for conveying containers each including one of said container bodies having thereon in telescoped relation one of said end units along a preselected path, first elongated heater means fixedly disposed longitudinally along said path for gradually heating adhesive of containers while passing along said path to a selected temperature whereat the adhesive is sufficiently flowable, pressing means overlying said path downstream of said first heater means for pressing an end unit into final position, and longitudinally elongated second heater means fixed downstream of said first heater means for maintaining the adhesive at said selected temperature for a selected period of time as the respective container continues passing along said path.

2. An adhesive activator assembly according to claim 1 wherein said pressing means has portions extending along said path coextensive with said second heater means.

3. An adhesive activator assembly according to claim 1 wherein said pressing means includes a moving pressing belt overlying said path.

4. An adhesive activator assembly according to claim 3 wherein said pressing belt also extends along said path coextensive with said first heater means.

5. An adhesive activator assembly according to claim 4 wherein there is associated with said pressing belt guide means opposing said conveyor, said guide means in the area of said first heater means positioning said pressing belt to apply only a light pressure on an end unit to maintain the container of which it is a part in an upright position.

6. An adhesive activator assembly according to claim 4 wherein there is associated with said pressing belt guide means opposing said conveyor, said guide means in the area of said second heater means positioning said pressing belt to apply an end unit positioning pressure on an end unit.

7. An adhesive activator assembly according to claim 6 wherein said guide means converges along said path towards said conveyor to gradually force an end unit down on its respective container body.

8. An adhesive activator assembly according to claim 4 wherein there is associated with said pressing belt guide means opposing said conveyor, said guide means in the area of said first heater means positioning said pressing belt to apply only a light pressure on an end unit to maintain the container of which it is a part in an upright position, and second heater means positioning said pressing belt to apply an end unit positioning pressure on an end unit.

9. An adhesive activator assembly according to claim 3 wherein said pressing means includes at least one resiliently urged roller extending transversely of said path and overlying and contacting said pressure belt to apply a resilient positive pressing force on said pressing belt at a time when adhesive of a container is sufficiently flowable.

10. An adhesive activator assembly according to claim 3 wherein said pressing means includes at least one resiliently urged roller extending transversely of said path and overlying and contacting said pressure belt to apply a resilient positive pressing force on said pressing belt at a time when adhesive of a container is sufficiently flowable, said roller being positioned between said heater means.

11. An adhesive activator assembly according to claim 3 wherein said pressing means includes at least one resiliently urged roller extending transversely of said path and overlying and contacting said pressure belt to apply a resilient positive pressing force on said pressing belt at a time when adhesive of a container is sufficiently flowable, said roller being positioned generally at a downstream end of said second heater means.

12. An adhesive activator assembly according to claim 5 wherein said guide means includes at least one resiliently urged roller extending transversely of said path and overlying and contacting said pressure belt to apply a resilient positive pressing force on said pressing belt at a time when adhesive of a container is sufficiently flowable.

13. An adhesive activator assembly according to claim 1 wherein each of said heater means is of the induction heating type and includes a pair of electrodes extending in transversely spaced relation along said path in positions closely overlying the path of container end units.

14. An adhesive applicator assembly according to claim 13 wherein said heater means are particularly adapted to heat end units of a domed configuration, and said electrodes are each in the form of a solid bar having at least one coolant passage therein and having an arched undersurface generally corresponding to said domed configuration.

15. An adhesive activator assembly according to claim 14 wherein said pressing means includes a moving pressing belt overlying said path, said electrodes having opposed faces notched and receiving therebetween said pressing belt.

16. A method of forming containers including finally positioning an end unit on a container body wherein the end unit is initially telescoped axially relative to the container body and there is a layer of heat meltable adhesive between the end unit and the container body, said method comprising the steps of serially moving containers, gradually reheating the adhesive of each container body to a temperature whereat the adhesive is freely flowable, while continuing the serial movement of the containers maintaining the adhesive substantially at said temperature, and while the adhesive is substantially at said temperature applying a compressive force on each moving container in an axial direction to further telescope the end unit and the container body and thereby further distribute the adhesive.

17. A method according to claim 16 wherein there are two independent heatings of the adhesive, one to bring the temperature of the adhesive to the desired temperature, and the other to substantially maintain said temperature.

18. A method according to claim 16 wherein a compressive force is applied axially to each container during all of the heating with the compressive force during the heating to increase the temperature of the adhesive being a light force only for maintaining the container in an upright position.

19. A method according to claim 16 wherein said compressive force is a resilient reaction force provided by passing each container beneath a resiliently mounted roller.

20. A method according to claim 17 wherein said compressive force is a resilient reaction force provided by passing each container beneath a resiliently mounted roller, the roller being located between the two independent heatings.

* * * * *